US011700982B2

(12) United States Patent
Beims

(10) Patent No.: US 11,700,982 B2
(45) Date of Patent: Jul. 18, 2023

(54) ERGONOMIC GRAB BAR

(71) Applicant: M-Power Bar, LLC, Fallston, MD (US)

(72) Inventor: William Douglas Beims, Pasadena, MD (US)

(73) Assignee: M-POWER BAR, LLC, Fallston, MD (US)

( * ) Notice: Subject to any disclaimer, the term of this patent is extended or adjusted under 35 U.S.C. 154(b) by 66 days.

(21) Appl. No.: 17/411,348

(22) Filed: Aug. 25, 2021

(65) Prior Publication Data

US 2022/0061607 A1 Mar. 3, 2022

Related U.S. Application Data

(60) Provisional application No. 63/071,153, filed on Aug. 27, 2020.

(51) Int. Cl.
*A47K 17/02* (2006.01)
*A47K 3/00* (2006.01)

(52) U.S. Cl.
CPC ..... *A47K 17/022* (2013.01); *A47K 3/003* (2013.01)

(58) Field of Classification Search
CPC .... A47K 17/022; A47K 3/003; E04F 11/1863
USPC ..... 4/576.1; 256/59
See application file for complete search history.

(56) References Cited

FOREIGN PATENT DOCUMENTS

| | | | | |
|---|---|---|---|---|
| EP | 1693529 A2 * | 8/2006 | ..... | A47K 17/022 |
| GB | 2147928 A * | 5/1985 | ..... | E04F 11/1863 |

* cited by examiner

*Primary Examiner* — Tuan N Nguyen
(74) *Attorney, Agent, or Firm* — Edell, Shapiro & Finnan, LLC

(57) ABSTRACT

A grab bar is disclosed. The grab bar includes an undulating grab portion. The undulating grab portion includes an outwardly angled section and an inwardly angled section that are connected by one or more parallel sections (i.e., one or more "plateau sections"). At one end, the grab portion includes a first mounting portion that can be connected (e.g., mounted) to a fixed surface. At its other end, the grab portion includes a second mounting portion that can be connected (e.g., mounted) to the fixed surface or any other fixed surface. The plateau section may include one or more inwardly extending subportions.

20 Claims, 7 Drawing Sheets

ERGONOMIC GRAB BAR

CROSS REFERENCE TO RELATED APPLICATIONS

This application claims priority to and is based on U.S. Patent Application No. 63/071,153, filed Aug. 27, 2020, entitled "Ergonomic Grab Bar," the entire disclosure of which is incorporated herein by reference.

FIELD OF INVENTION

The present application relates to grab bars, such as grab bars that assist the disabled, elderly, and those with other physical considerations when moving around an indoor space, such as while transferring from a toilet seat to a wheel chair, from a wheel chair to a shower seat, and/or from a prone to standing position in a bathtub.

BACKGROUND OF THE INVENTION

Typically, grab bars are provided as linear bars that comply with industry standards, which require that a grab bar be a specific diameter (e.g., 1.5 inches), must be continuous over its length, and must return to the wall to alleviate garment entanglement with bar ends. The most common standard-compliant grab bars—42 inch, 36 inch, and 24 inch commercial and institutional, linear grab bars—have been utilized for decades and are fabricated in accordance with national guidelines. An example standardized, linear grab bar 10 is shown in FIGS. 1A-1D.

As can be seen, grab bar 10 extends from a first wall mount 11 to a second wall mount 12. A first curved section 13 extends from the first wall mount 11 and turns through a radius of approximately 90 degrees. Likewise, a second curved section 14 extends from the second wall mount 12 and turns through a radius of approximately 90 degrees. Curved sections 13 and 14 are connected by a linear grab section 15. As is shown in FIG. 1C, curved sections 13 and 14 space the linear grab section 15 from a wall W on which the grab bar 10 is mounted by a gap G; which has a constant width along the length of the linear grab section 15. The length of the gap G may be determined by the radii of curved sections 13 and 14 and the length of linear grab section 15 (which may be dictated based on standard sizing options, e.g., for the 42 inch, 36 inch, and 24 inch commercial and institutional, linear grab bars, mentioned above).

Unfortunately, standard-compliant linear bars, such as grab bar 10 are often unsuitable or suboptimal for the users that need them. For example, many people with disabilities can neither form a fist nor grasp the diameter of a standard-compliant grab bar; instead, many of these users must try to place their forearm along the length of the bar during a transfer. However, as is shown in FIGS. 1B and 1C, a linear grab bar, such as grab bar 10, provides a narrow, linear, contact area 20 (e.g., the portion of the bar shown within arm A). In fact, the width W2 of the contact area 20 (see FIG. 1B) is, at best, defined by the diameter of the grab section 15 and, in reality, smaller than the diameter of grab section 15 (since the grab section 15 is cylindrical). This narrow, linear, contact area 20 provides minimal and inadequate support that can lead to a dangerous slippage and/or rotation of an arm that may lead to falls. For example, as is shown in FIG. 1A, a person's elbow may slip off a rounded grip bar and drop into the gap G between the bar 10 and the wall W. An arm slipping into gap G may lead to an injury in and of itself, but such a slip may be even more dangerous if the person falls or otherwise lurches with their arm lodged in the gap G.

Still further, and now turning to FIG. 1D, typical standard-compliant grab bars, such as grab bar 10, do not provide suitable assistance along the length of the bar. The design of many current grab bars assumes that a transfer will be made with arms perpendicular to the length of the bar—typical toilet stall side transfers—as is shown by arm position P1, where the lower arm and hand of a user are both aligned along a single axis A1 when a user is gripping grab bar 10. Perpendicular conditions are better for those with weakened abilities to grasp and pull; however, many, if not most, transfers actually occur in parallel or skew conditions (i.e., when a user grasps the bar with his/her arm parallel to the bar or skewed with respect to the bar), an example of which is illustrated by arm position P2.

As is shown, in skewed situations (e.g., arm position P2), a user will need to bend his/her wrist to grip the bar 10 and support themselves during a transfer (e.g., while moving from a sitting or prone position into a standing position or into a wheelchair) so that a longitudinal hand axis A2 is angled at an acute angle θ1 with respect to an arm axis A3. Acute wrist angles (e.g., angle θ1 created by arm position P2) leads to hand slippage and/or requires the bar user to have sufficient upper body strength to pull upright from a sitting or prone position. To try to address this, some grab bars have swing away devices, but swing away devices are prone to failure and can create dangerous pinch points. Moreover, swing away devices do not conform to the regulatory standards.

In view of the foregoing, enhanced grab bars are desired.

SUMMARY OF THE INVENTION

The grab bar presented herein enhances existing grab bars to meet the specific and neglected needs of the disabled, elderly, and other communities needing a grab bar, while adhering to industry standards. That is, the grab bar presented herein may be safer and easier to use than known grab bars and may be suitable for institutions that must comply with industry standards.

In one form, the grab bar presented herein includes an undulating grab portion. The undulating portion includes an outwardly angled section and an inwardly angled section that are connected by a parallel section (i.e., a "plateau section"). At one end, the grab portion includes a first mounting portion that can be connected (e.g., mounted) to a wall or any other fixed surface. At its other end, the grab portion includes a second mounting portion that can be connected (e.g., mounted) to a wall or any other fixed surface. The first end may be included on or extend from the outwardly angled section and the second end may be included on or extend from the inwardly angled section.

In some instances, the plateau section is the only portion of the grab bar that extends parallel to the wall or other fixed surface(s) on which the grab bar is mounted. Alternatively, the plateau section may include one or more inwardly extending subportions. Each inwardly extending subportion may include an inwardly angled subsection, an outwardly angled subsection, and a parallel subsection. In some instances, an inwardly angled subsection may be parallel to the inwardly angled section (e.g., the section extending from the first end), the outwardly angled subsection may be parallel to the outwardly angled section (e.g., the section extending from the second end), and/or the parallel subsection may be parallel to the plateau section. Alternatively, the subsections may extend at different angles relative to the first outwardly extending section and first inwardly extending section of the grab bar and/or relative to other subportions. Put another way, overall, the grab bar may have a single plateau or may define multiple plateaus, of identical or differing sizes and shapes.

In any case, the grab bar may have a constant diameter along a length of the bar. Moreover, the grab bar presented herein may be solid and may not include any movable pieces so that the grab bar does not define any pinch points. Still further, in at least some instances, the grab bar may not define any acute angles and/or tight spaces that might trap a user's extremities.

BRIEF DESCRIPTION OF THE DRAWINGS

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures.

Like reference numerals have been used to identify like elements throughout this disclosure.

DETAILED DESCRIPTION

Overall, the grab bar presented herein includes a standard-compliant undulating grab portion or section. The undulations (or non-linear extension) enable a user to avoid skewed transfers in which the user grasps a grab bar with a weakened arm/grip position (e.g., with an acute wrist angle created by angling of a hand with respect to the lower arm). Moreover, the undulations or angles in the grab portion/section may create a wider resting contact area for parallel transfers, at least as compared to grab bars with linear grab sections, which provide a resting contact area defined by a diameter of a linear grab section. This combination of features may be particularly advantageous for disabled people, elderly people, or any other people with weakened muscular systems. Moreover, in at least some embodiments, the grab bar presented herein is static (i.e., stationary) once installed, has a constant diameter, and does not create pinch points. Thus, the grab bar presented herein may be fully standard-compliant.

Figure 2B:
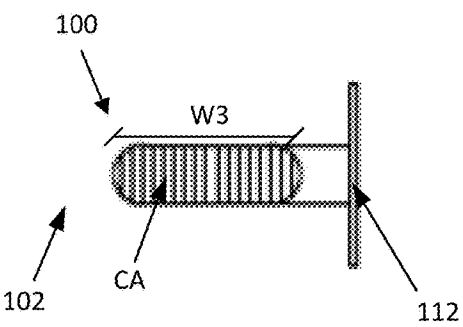
FIGS. 2A-2C illustrate front, side, and bottom views, respectively, of an example embodiment of the grab bar presented herein, with a person's arm shown acting on the grab bar during an example parallel transfer.
Figure 2A:
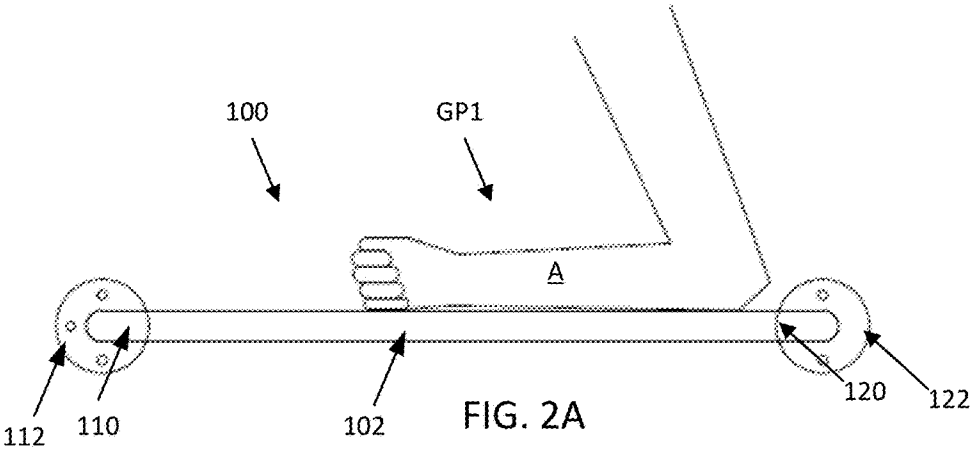
Figure 2C:
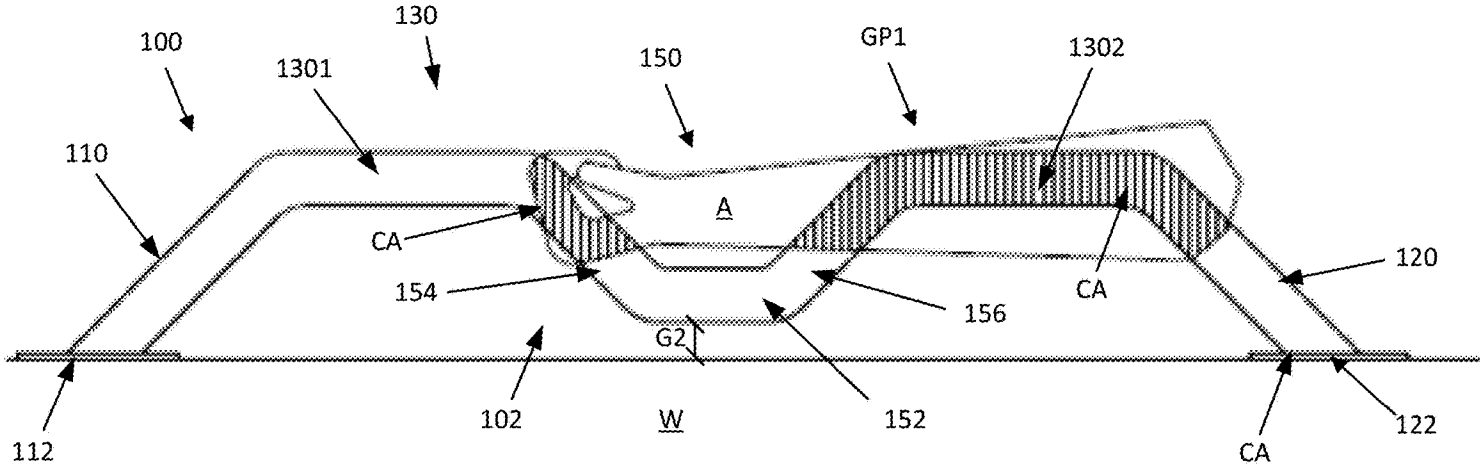

Now turning to FIGS. 2A-2C, these Figures depict a first example embodiment of the ergonomic grab bar 100 formed in accordance with the present application. The grab bar 100 extends from a first mounting portion 112 to a second mounting portion 122. More specifically, an undulating grab portion 102 (also referred to as non-linear grab portion 102) extends from the first mounting portion 112 to the second mounting portion 122, with a first angled section 110 extending away from the first mounting portion 112, a second angled section 120 extending away from the second mounting portion 122, and one or more plateau sections 130 extending therebetween.

Generally, the first angled section 110 is angled towards the second angled section 120; however, for the purposes of this application, the first angled section 110 may be referred to as inwardly angled section 110 and the second angled section 120 may be referred to as the outwardly angled section 120. "Outwardly" indicates that the section extends at least partially away from a fixed surface, such as a wall, and "inwardly" indicates the section extends back towards a fixed surface (the same fixed surface or another fixed surface). Thus, technically, sections 110 and 120 could each be described as inwardly or outwardly extending, depending on perspective, but the description of one of section 110 and 120 as inwardly or outwardly should be paired with an opposite description of the other one of section 110 and 120. Consequently, angled sections 110 and 120 can connect, directly or indirectly, the one or more plateau sections 130 to one or more fixed surfaces so that both ends of the undulating grab portion 102 can be mounted on a fixed surface and prevent potential garment entanglement issues, per industry standards.

Regardless of the terminology used to describe sections 110 and 120, section 110 may define or include a first end of the undulating grab portion 102. Similarly, section 120 may define or include a first end of the undulating grab portion 102. For example, sections 110 and 120 may define the ends of undulating grab portion 102 or may be coupled to additional pieces or parts that define the ends of undulating grab portion 102. Additionally or alternatively, first mounting portion 112 may be integrally formed with or coupled to a distal end of first angled section 110 and/or second mounting portion 122 may be integrally formed with or coupled to a distal end of second angled section 120. In fact, in some embodiments, mounting portions 112 and 122 may define the distal ends of undulating grab portion 102.

Still referring to FIGS. 2A-2C, but now with a focus on FIG. 2C, in the depicted embodiment, the undulating grab portion 102 includes a plateau section 130 with two plateau subsections—subsection 1301 and subsection 1302—and an inwardly extending subportion 150 (also referred to herein as a grip subportion 150). The inwardly extending subportion 150 is substantially centered between plateau subsection 1301 and plateau subsection 1302, and includes an inwardly angled subsection 156, an outwardly angled subsection 154, and a parallel subsection 152. However, in other embodiments, the inwardly extending subportion 150 need not be centered between plateau sections/subsections and can be positioned between plateau sections/sub sections of different sizes. Alternatively, one end of an inwardly extending subportion 150 can be positioned adjacent a single plateau sections 130 and an opposite end of the inwardly extending subportion 150 can abut angled section 110 or angled section 120.

Still further, although not shown, in some embodiments, undulating grab portion 102 need not include an inwardly extending subportion 150 and can include a single plateau section 130 that extends between the first angled section 110 and the second angled section 120. That is, the undulating grab portion 102 may be configured so that the plateau section 130 is the only section/portion of the undulating grab portion 102 that extends parallel to a fixed surface, such as wall W of FIG. 2C, on which the grab bar 100 is mounted. Such a construction (without an inwardly extending subportion 150) may still be considered undulating for the purposes of this application, with angled sections 110 and 120 creating the advantageous undulations.

That all said, when the undulating grab portion 102 includes the inwardly extending subportion 150, subsections 152, 154, and 156 of the inwardly extending subportion 150 may have any desired shape and size. For example, in the depicted embodiment, the outwardly angled subsection 154 is the same length as and substantially mirrors the inwardly angled subsection 156, while the parallel subsection 152 extends therebetween. Additionally, in the depicted embodiment, the outwardly angled subsection 154 extends substantially parallel to the second angled section 120, the inwardly angled subsection 156 extends substantially parallel to the first angled section 110, and the parallel subsection 152 extends substantially parallel to plateau subsection 1301 and plateau subsection 1302. However, in other embodiments, a subset of these relationships may hold true, or none of these relationships may hold true.

That is, some or none of subsections 152, 154, and 156 may be parallel to sections or other subsections of undulating grab portion 102. For example, the inwardly angled subsection 156 and the outwardly angled subsection 154 may extend at different angles than the inwardly angled section 110 and the outwardly angled section 120, respectively. Likewise, outwardly subsection 154 and inwardly angled subsection 156 may have varied dimensions relative to each other (e.g., different lengths).

Still referring to FIGS. 2A-2C, but now with a focus on FIGS. 2A and 2B, in the depicted embodiment, the undulating grab portion 102 has a constant diameter along its length. For example, the undulating grab portion 102 may have a constant diameter of approximately 1.25 inches, approximately 1.5 inches, or any other suitable diameter. Meanwhile, the transition between sections/subsections/subportions 110, 1301, 154, 152, 156, 1302, and 120 are rounded and have obtuse interior angles, avoiding creation of pinch points. For example, interior angles between central longitudinal axes of different sections or subsections of the undulating grab portion 102 measure approximately 135 degree, but other embodiments may have different interior angles. Furthermore, it is to be understood that the angles presented on the exterior of the grab bar may vary from these interior angles since the exterior of the undulating grab portion may be smoothed or rounded with radii of varying dimensions (to remove sharp corners).

Still further, the first mounting portion 112 and the second mounting portion 122 may fixedly couple both ends of the undulating grab portion 102 to one or more fixed surfaces (e.g., a single wall, such as wall W of FIG. 2C) so that the undulating grab portion 102 is static when coupled (e.g., mounted) to one or more fixed surfaces. In view of these features (e.g., constant diameter, static mounting, and obtuse interior angles), as well as other features, the undulating grab portion 102 may compliant with industry standards.

In the depicted embodiments, every section and subsection of the undulating grab portion 102 (e.g., sections/subsections 110, 1301, 154, 152, 156, 1302, and 120) may span a length of approximately 6 inches, as measured along its central longitudinal axis. Collectively, these measurements provide exterior linear sections spanning approximately six inches at sections/subsections 110, 1301, 1302, and 120, and exterior linear sections spanning approximately three inches at subsections 154, 152, and 156. As is described below, these linear portions of the undulating grab portion 102 may provide grip points, but are short enough to create wide resting contact areas atop the undulating grab portion 102. Additionally, with these dimensions, a gap G of approximately 0.875 inches may be disposed between subsection 152 and a wall W to which the undulating grab portion 102 is mounted, which avoids creating a pinch point. Finally, with these dimensions, the grab bar 100 has an overall length, as measured from a center of first mounting portion 112 to a center of second mounting portion 122, in a range of approximately 20-29 inches, such as approximately 24 inches or approximately 29 inches. However, all of the aforementioned dimensions are examples and one or more of these dimensions may vary in different embodiments.

Still referring to FIGS. 2A-2C, due to the structural design of the grab bar 100 presented herein, the bar 100 has surface areas that allow a forearm can rest atop the bar 100 while bridging over several bends in the bar, as illustrated by a forearm A in a grip position GP1 in FIGS. 2A and 2C. That is, the undulations of the undulating grab portion 102 of grab bar 100 create a resting contact area CA at least partially defined between the inwardly angled section 110 and the outwardly angled section 120 so that the resting contact area CA spans sections of the undulating grab portion 102 extending in different directions (as opposed to a single linear direction). Put yet another way, resting contact area CA is not defined by a shape of constant dimensions; the resting contact area is a non-linear resting contact area CA (by comparison, known grab bars define a resting contact area that is primarily linear, with a fixed width along its length). Thus, the resting contact area CA has a maximum width W3 that is wider than a diameter of the undulating grab portion 102 (e.g., wider than approximately 1.25 inches, approximately 1.5 inches, etc.).

These properties of the resting contact area CA (e.g., enlarged width W3) allow those who are unable to forcefully grasp a grab bar to safely rely upon forearm use for lift and transfer. Moreover, since the grab bar 100 provides engages an arm A disposed in a parallel transfer position GP1 at points of contact that extend in multiple directions (e.g., along the length of the arm and along the width of the arm), the grab bar 100 prevents or at least discourages rotation of the arm around the grab bar 100, reducing the risk of injury. That is, the resting contact area CA allows for the bridging of the forearm across a wider footprint (see width W3) and discourages or prevents a user's arm A from rotating towards or away from a fixed surface (e.g., wall W) on which the bar 100 is mounted (and off the bar). In some instances, the width W3 of resting contact area CA may be at least 4.25 inches, without including rounded edges (see FIG. 2B).

Figure 1B:
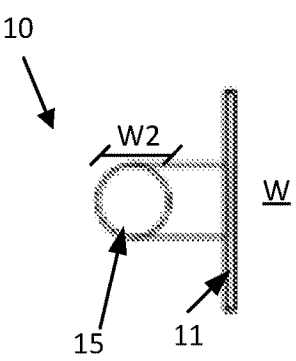
FIG. 1B PRIOR ART
FIGS. 1A-1C illustrates front, side, and bottom views, respectively, of a prior art grab bar, with a person's arm shown at least partially engaging the grab bar during a parallel transfer in FIGS. 1A and 1C.
Figure 1A:
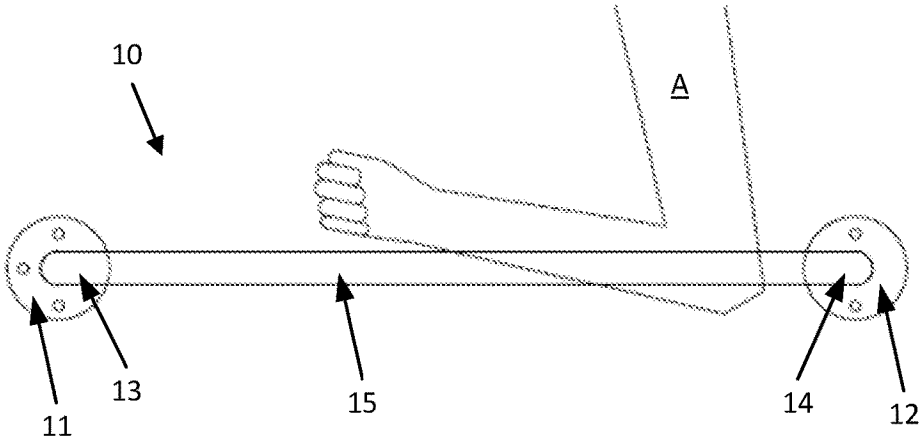
FIG. 1A PRIOR ART
Figure 1C:
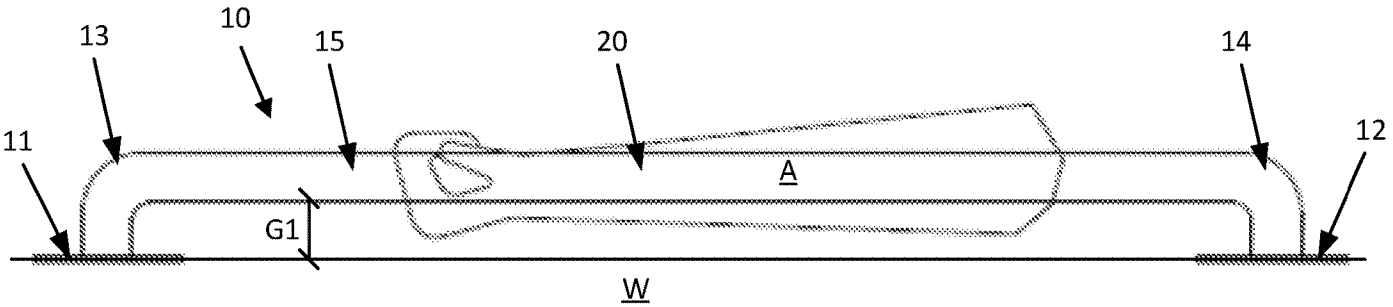
FIG. 1C PRIOR ART

By comparison, conventional grab bars, such as bar 10 of FIGS. 1A-1D, do not prevent such rotation during a parallel transfer, as shown in FIG. 1A. This is because standard, straight grab bars, like bar 10, provide a minimal horizontal contact area, as demonstrated by width W2 shown in FIG. 1B. Put another way, the width W3 of the resting contact area CA of the grab bar presented herein is larger than the width W2 of a contact area (defined by a tube diameter) of standard, straight grab bars, like bar 10, and, thus provides added stability and safety.

Figure 3:
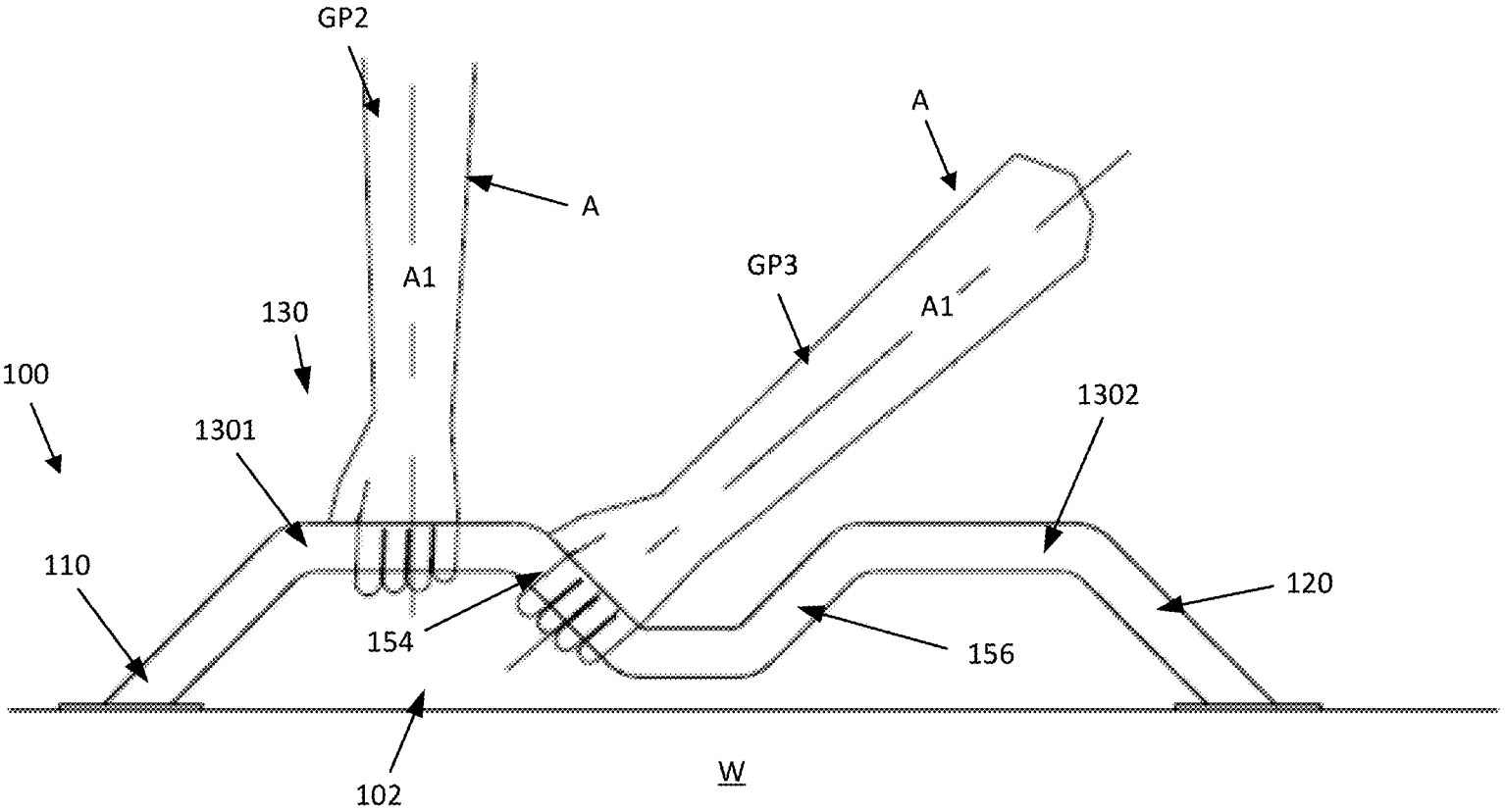
FIG. 3 illustrates a top view of the grab bar of FIGS. 2A-2C, with arms shown acting on the grab bar during example transfers.

Still further, and now turning to FIG. 3, due to its structural design, the grab bar 100 presented herein is suitable for traditional perpendicular transfers via the one or more plateau sections 130 included in the undulating grab portion 102, as shown by the arm A in position GP2 in FIG. 3, similar to how conventional grab bars support perpendicular transfers. However, as mentioned, perpendicular transfers, where the longitudinal axis A1 of an arm A approaching the bar 100 is perpendicular to a wall on which the grab bar 100 is mounted, are rarely completed by end users. This position (e.g., GP2) is oftentimes used by attendants assisting the disabled or with side transfer conditions while moving from a wheelchair to a toilet. Instead, transfers from the toilet or prone position to the upright position or back to a wheelchair, are more frequently initiated from skewed positions, as is illustrated by arm position P2 in FIG. 1D.

Figure 1D:
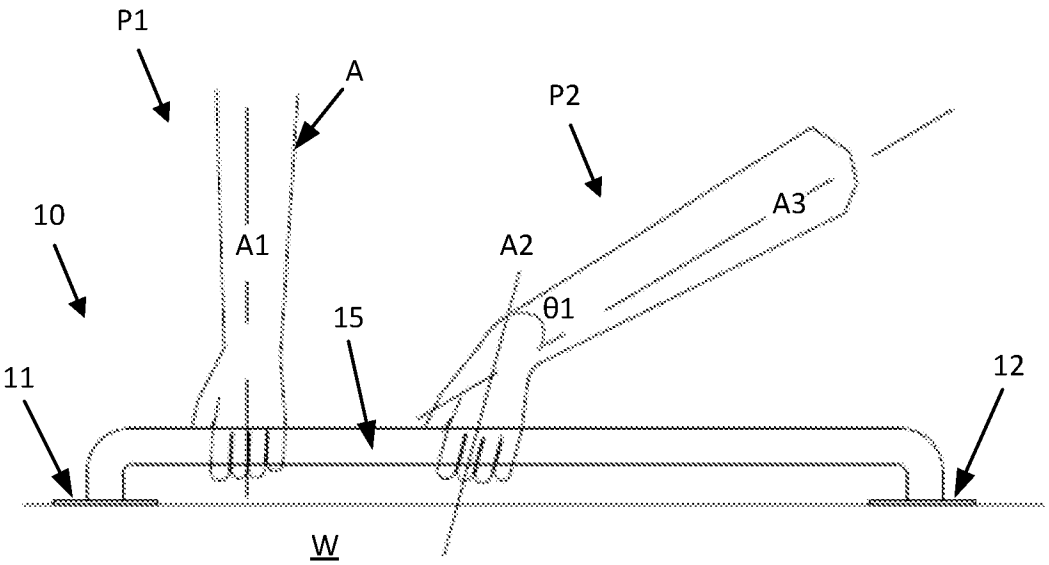
FIG. 1D PRIOR ART
FIG. 1D illustrates a top view of the prior art grab bar of FIGS. 1A-1C, with arms shown acting on the grab bar during perpendicular and angled or skewed transfers.

More specifically, as is shown in FIG. 1D, if a user grabs a traditional, straight bar from an angle (i.e., at a skewed approached, per position P2), his/her wrist will have to bend at an awkward angle θ1 to orient a hand in a grip position while the longitudinal axis A3 of the arm is skewed with respect to the bar. Not only is this potentially unsafe for a user, who may be using the grab bar due to diminished muscular strength from age or disability, but this angle θ1 also minimizes the pulling ability the person grasping the grab bar. By comparison, as shown in FIG. 3, the grab bar 100 presented herein enables a user to complete a perpendicular transfer from positions that typically requires a skew transfer. That is, if a user is in a position that typically requires a skew transfer (e.g., not directly facing wall W), the user can utilize grip position GP3, where the user can keep his/her arm straight (i.e., aligned along longitudinal axis A1). That is, if a user approaches the grab bar presented herein from a skewed angle, the user can grasp the bar in position GP3 and avoid a skewed transfer and the associated severe bending and hampering of strength witnessed in FIG. 1D.

Notably, in FIG. 3, the arm A in position GP3 is shown grabbing an angled subsection 154 of a subportion of the grab bar; however, the user might also grab angled section 110 or angled section 120 (i.e., the first inward section or the first outward section) with similar effectiveness. Thus, if the grab bar 100 only included a single plateau section 130 extending between angled sections 110 and 120, the grab bar may still effectively facilitate perpendicular transfers from traditional skew positions, perpendicular transfers from traditional perpendicular positions, and safer parallel transfers along a widened resting contact area CA.

Figure 4:
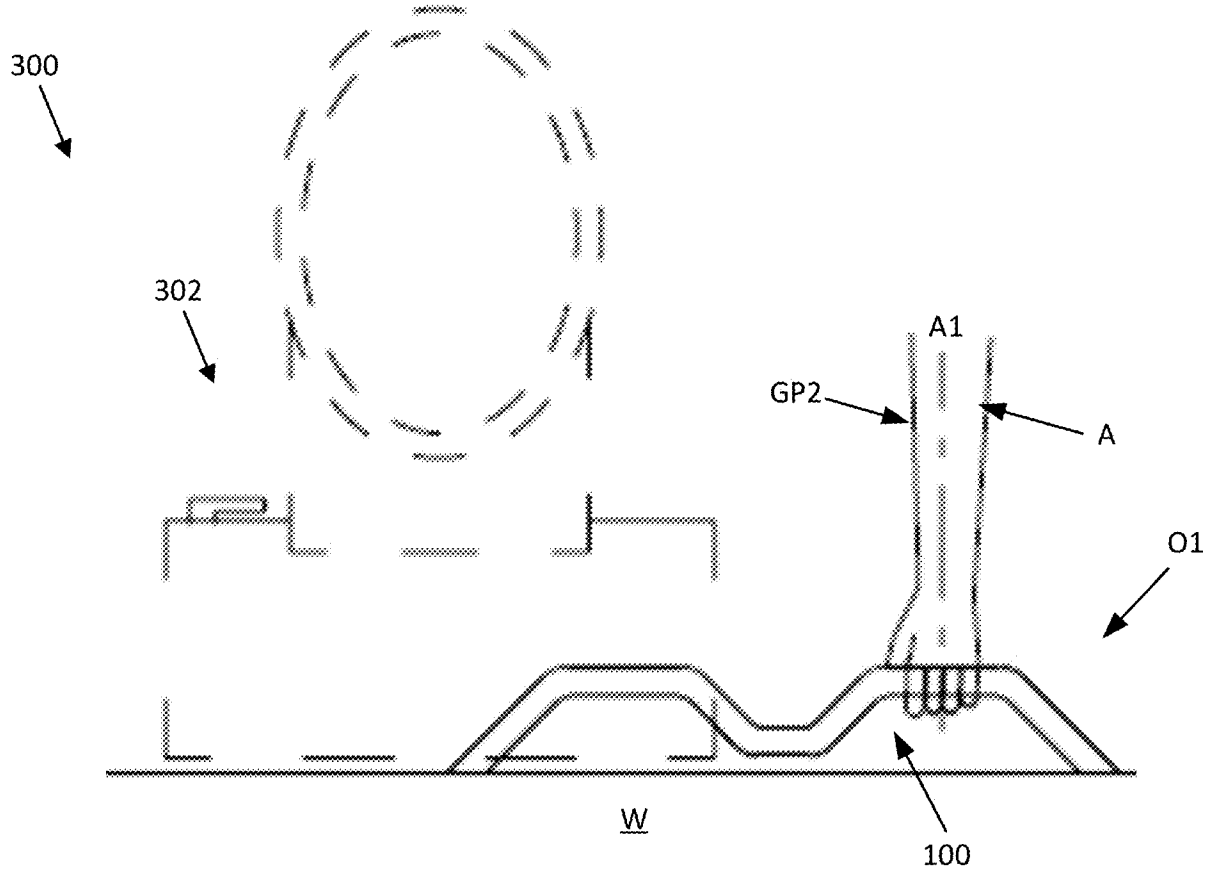
FIGS. 4 and 5 illustrate the grab bar of FIGS. 2A-2C installed in two different environments, with the grab bar being oriented in a horizontal orientation in FIG. 4 and a vertical orientation in FIG. 5.
Figure 5:
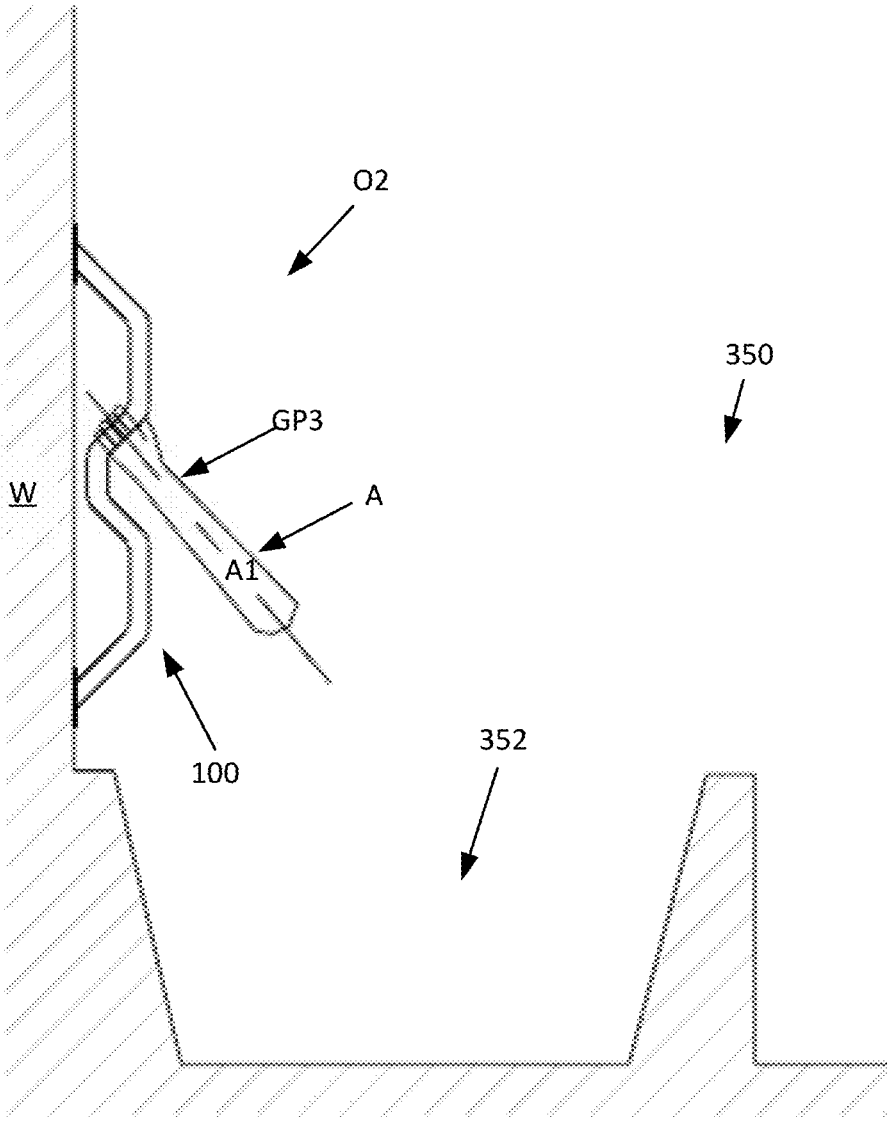

Now referring to FIGS. 4 and 5, in some instances, the grab bar 100 presented herein may be oriented horizontally, but in other instances, the grab bar 100 may be oriented vertically. FIG. 4 illustrates an example bathroom environment 300 in which the grab bar 100 is oriented in a horizontal orientation O1, above a toilet 302. By comparison, FIG. 5 illustrates an example bathroom environment 350 in which the grab bar 100 is oriented in a vertical orientation O2, above a bathtub/shower 352. Notably, with a grab bar 100 disposed in a horizontal orientation O1 above a toilet 302, a user can rotate on a toilet seat and grab the bar 100 for a perpendicular transfer while seated. By comparison, a user must be completely facing a linear grab bar (e.g., bar 10) to initiate a perpendicular transfer, which is nearly impossible to achieve will seated on a toilet 302 beneath a grab bar.

A vertical orientation O2, as illustrated in FIG. 5, also offers a number of advantages. Most notably, placing the grab bar 100 in a vertical orientation O2 (e.g., for use in a shower or bathtub 352) will reduce hand slippage that is often experienced in traditional straight bars. That is, if a traditional grab bar, such as bar 10, is disposed vertically, a user's hand may slide down the grab bar along a length of the grab bar, especially if the grab bar is wet. Meanwhile, the undulations of the undulating grab portion 102 of grab bar 100 may provide stops or push points that a user can leverage to prevent or discourage downwards slipping. Moreover, these stops or push points may create more efficiency and force when a user us pulling upright.

Furthermore, transferring from a seated position in a tub or shower seat (disposed in shower/bathtub 352) to the standing position, the disabled/elderly are typically reliant upon a grab bar that has both a horizontal and vertical leg—grabbing the vertical offers no support due to hand slippage, and grasping the horizontal bar is only beneficial if the user is directly under the bar (e.g., not in a skewed position). The grab bar presented herein allows a user to utilize a single grab bar from any position in the shower or tub and the grab bar presented will minimize slippage due to its undulations.

Figure 6:
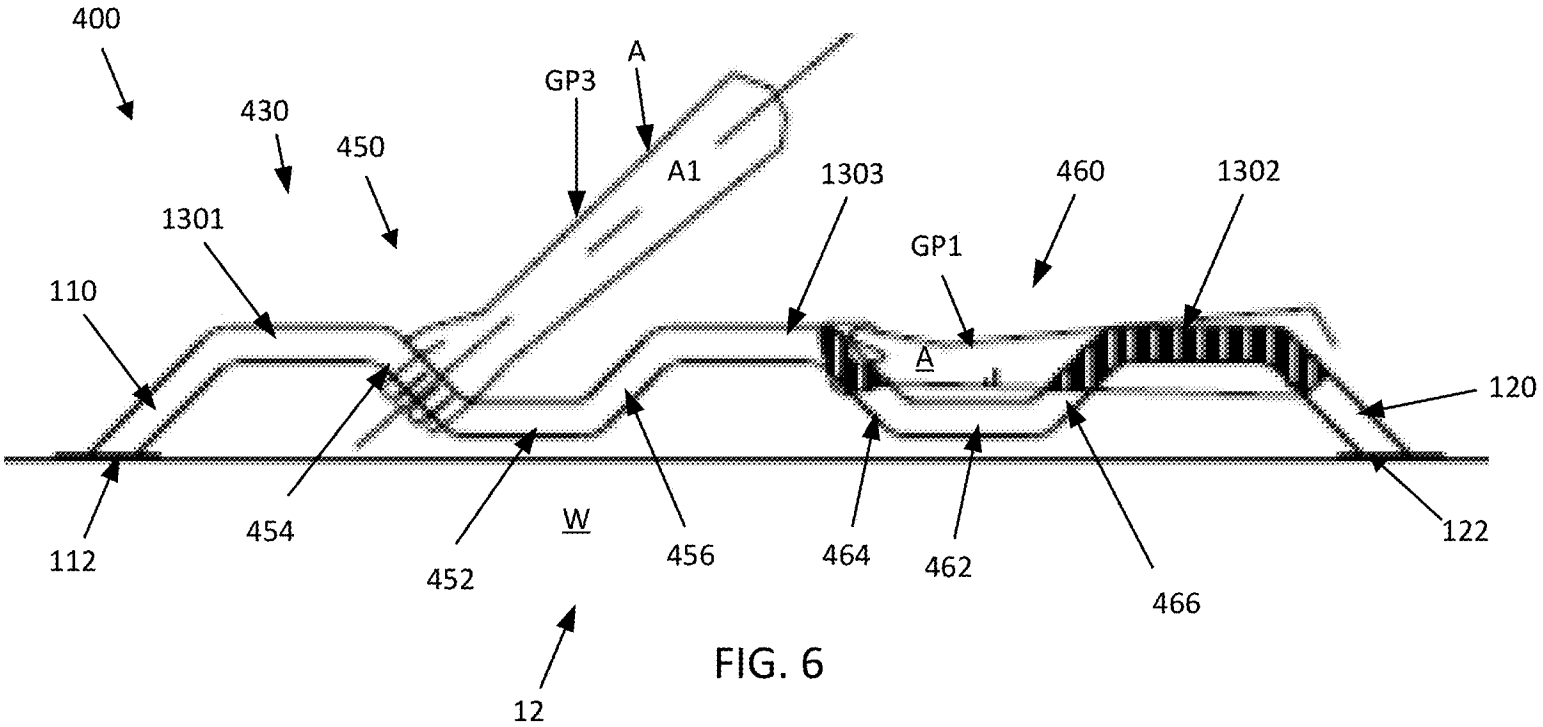
FIG. 6 illustrates a top view of another example embodiment of the grab bar presented herein, with arms shown acting on the grab bar during example transfers.

Now turning to FIG. 6 for a description of another example grab bar 400 formed in accordance with the present application. Grab bar 400 is substantially similar to grab bar 100 and, thus, for brevity, only the differences between grab bar 100 and grab bar 400 are discussed in detail and any description of grab bar 100 included herein should be understood to apply to grab bar 400, especially if like numerals are used to number the parts of grab bar 400. The most notable differences are that grab bar 400 includes two inwardly extending subportions—first subportion 450 and second subportion 460—and a plateau section 430 with three plateau sebsections—subsection 1301, subsection 1302, and subsection 1303.

Put simply, in grab bar 400, the inwardly extending subportion 150 is duplicated and the two subportions are connected by a third plateau portion. More specifically, the first inwardly extending subportion 450 includes an inwardly angled subsection 456, an outwardly angled subsection 454, and a parallel subsection 452. Likewise, the second inwardly extending subportion 460 includes an inwardly angled subsection 466, an outwardly angled subsection 464, and a parallel subsection 462. The first inwardly extending subportion 450 is coupled to the first angled section 110 and the second inwardly extending subportion 460 is coupled to the second angled section 120. Then, the first inwardly extending subportion 450 is coupled to the second inwardly extending subportion 460 via a third plateau subportion 1303.

However, grab bar 400 is merely an example of an alternative embodiment of grab bar 100 and other embodiments may have any number of subsections that create any number of plateau sections. For example, the grab bar presented herein might have no subsections (only including an outwardly angled section, an inwardly angled section, and a plateau section) or two or more subsections. If the grab bar includes two or more subsections, the subsections may be directly connected to each other or separated from each other by a plateau section.

Although the grab bar presented herein has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, the grab bar presented herein can include any number or combination undulations, of any dimensions.

Additionally or alternatively, the grab bar presented herein might be fabricated with a bend or turn to allow corner installation or any other shape to allow installation along non-straight walls. Moreover, various features from one of the embodiments may be incorporated into another of the embodiments. Accordingly, it is appropriate that the appended claims be construed broadly and in a manner consistent with the scope of the disclosure as set forth in the following claims.

It is also to be understood that the grab bar described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof. That said, it may be preferable to manufacture the grab bar presented herein from materials that satisfy industry standards.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Similarly, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

The invention claimed is:

1. A grab bar comprising:

a first mounting portion disposed at a first end of the grab bar;

a second mounting portion disposed at a second end of the grab bar, wherein the first and second mounting portions can be coupled to one or more fixed surfaces; and an undulating grab portion including a flat outwardly angled section and a flat inwardly angled section that are connected by one or more flat plateau sections, the undulating grab portion extending entirely between the first mounting portion and the second mounting portion in a flat manner so that the undulating grab portion provides planar opposing surfaces along a length of the undulating grab portion, wherein the planar opposing surfaces are normal to the one or more fixed surfaces, so that a flat, non-linear resting contact area is configurable to horizontally support a forearm of a user leveraging the grab bar.

2. The grab bar of claim 1, wherein the first end is included on or extends from the flat outwardly angled section and the second end is included on or extends from the flat inwardly angled section.

3. The grab bar of claim 1, wherein the one or more flat plateau sections each include a flat section that extends linearly in a direction that is parallel to at least one fixed surface of the one or more fixed surfaces on which the grab bar is mounted to define a flat, linear section spaced apart from the at least one fixed surface, and the flat section is the only section of the undulating grab portion extending parallel to the at least one fixed surface of the one or more fixed surfaces.

4. The grab bar of claim 1, wherein a plateau section of the one or more flat plateau sections comprises an inwardly extending subportion including an inwardly angled subsection, an outwardly angled subsection, and a parallel subsection.

5. The grab bar of claim 4, wherein the inwardly angled subsection is parallel to the flat inwardly angled section.

6. The grab bar of claim 4, wherein the outwardly angled subsection is parallel to the flat outwardly angled section.

7. The grab bar of claim 4, wherein the parallel subsection extends linearly in a direction that is parallel to at least one plateau section of the one or more flat plateau sections to define a flat, linear section spaced apart from at least one fixed surface of the one or more fixed surfaces on which the grab bar is mounted.

8. The grab bar of claim 4, wherein the inwardly angled subsection and the outwardly angled subsection extend at different angles than the flat outwardly angled section and the flat inwardly angled section, respectively.

9. The grab bar of claim 1, wherein the undulating grab portion has a constant diameter along its length.

10. The grab bar of claim 1, wherein the grab bar is static when coupled to the one or more fixed surfaces.

11. The grab bar of claim 1, wherein the undulating grab portion has obtuse angles between its sections, between its subsections, and between the sections and the subsections.

12. The grab bar of claim 1, wherein the undulating grab portion defines a resting contact area that is wider than a diameter of the undulating grab portion, the resting contact area being defined in a plane intersecting a top of the flat outwardly angled section, a top of the flat inwardly angled section, and a top of the one or more flat plateau sections.

13. The grab bar of claim 12, wherein the resting contact area that is at least partially defined between the flat outwardly angled section and the flat inwardly angled section.

14. A grab bar comprising:

a first mounting portion disposed at a first end of the grab bar;

a second mounting portion disposed at a second end of the grab bar, wherein the first and second mounting portions can be coupled to one or more fixed surfaces; and a non-linear grab portion with a constant diameter that extends between the first mounting portion and the second mounting portion to define a flat, non-linear resting contact area that has a maximum width that is wider than the constant diameter of the non-linear grab portion, wherein the flat, non-linear resting contact area extends entirely in a plane that: (a) intersects the first mounting portion; (b) intersects the second mounting portion; and (c) is normal to the one or more fixed surfaces, so that the flat, non-linear resting contact area is configurable to horizontally support a forearm of a user leveraging the grab bar.

15. The grab bar of claim 14, wherein the non-linear grab portion comprises:

a first flat angled section extending from the first mounting portion;

a second flat angled section extending from the first mounting portion, the first flat angled section angled towards the second flat angled section; and one or more flat plateau sections that connect the first flat angled section and the second flat angled section.

16. The grab bar of claim 15, wherein the one or more flat plateau sections extend linearly in a direction that is parallel to at least one fixed surface of the one or more fixed surfaces on which the grab bar is mounted to define flat, linear sections spaced apart from the at least one fixed surface.

17. A grab bar comprising:

a first mounting portion disposed at a first end of the grab bar;

a second mounting portion disposed at a second end of the grab bar, wherein the first and second mounting portions can be coupled to one or more fixed surfaces; and a static, angled grab portion that extends between the first mounting portion and the second mounting portion to define a flat, non-linear resting contacting area that extends entirely in a plane that: (a) intersects the first mounting portion; (b) intersects the second mounting portion; and (c) is normal to the one or more fixed surfaces, so that the flat, non-linear resting contact area is configurable to horizontally support a forearm of a user leveraging the grab bar.

18. The grab bar of claim 17, wherein the static, angled grab portion comprises:

a first flat angled section extending from the first mounting portion; and a second flat angled section extending from the first mounting portion, the first flat angled section angled towards the second flat angled section.

19. The grab bar of claim 18, wherein the static, angled grab portion further comprises:

one or more flat plateau sections that connect the first flat angled section and the second flat angled section.

20. The grab bar of claim 17, wherein the static, angled grab portion has a constant diameter and defines the flat, non-linear resting contact area to be wider than the constant diameter.

* * * * *